United States Patent [19]

Fearon

[11] 4,009,664

[45] Mar. 1, 1977

[54] CLOSURE ACTUATING DEVICE FOR RAILWAY HOPPER CAR DOORS

[75] Inventor: Joseph G. Fearon, Boise, Ohio

[73] Assignee: Morrison-Knudsen Company, Inc., Boise, Idaho

[22] Filed: Mar. 12, 1975

[21] Appl. No.: 557,591

[52] U.S. Cl. ..... 105/239; 105/252; 105/283; 105/308 R; 222/536

[51] Int. Cl.[2] ..... B61D 7/06; B61D 7/18; B61D 7/26; B61D 49/00

[58] Field of Search ..... 105/239, 280, 281, 283, 105/248, 252, 296, 308 R; 222/536

[56] References Cited

UNITED STATES PATENTS

| | | | |
|---|---|---|---|
| 287,663 | 10/1883 | Godwin | 105/283 |
| 1,800,832 | 4/1931 | Hindahl | 105/283 X |
| 2,042,528 | 6/1936 | Hosceit | 105/283 X |
| 3,654,872 | 4/1972 | Fearon | 105/239 |
| 3,822,650 | 7/1974 | Fearon | 105/239 |

*Primary Examiner*—Robert J. Spar
*Assistant Examiner*—Howard Beltran
*Attorney, Agent, or Firm*—Seed, Berry, Vernon & Baynham

[57] ABSTRACT

A closure actuating device is disclosed for freeing rotation of discharge control doors for railway hopper cars of the type where the door assembly is supported for rotation about a pivotal axis parallel to and beneath the discharge opening in the railway car. To alleviate sticking of the doors due to compaction of fines on the upper surface of the control doors which cover the discharge openings, the device lowers the control doors to increase the clearance between the terminating edges of the discharge openings and the upper surface of the discharge door.

2 Claims, 4 Drawing Figures

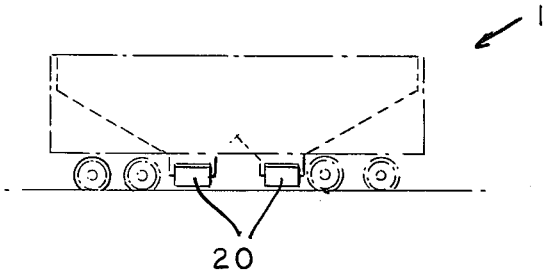
FIG. 1
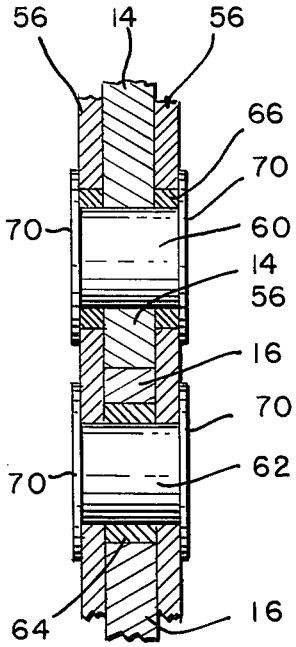
FIG. 4
FIG. 2
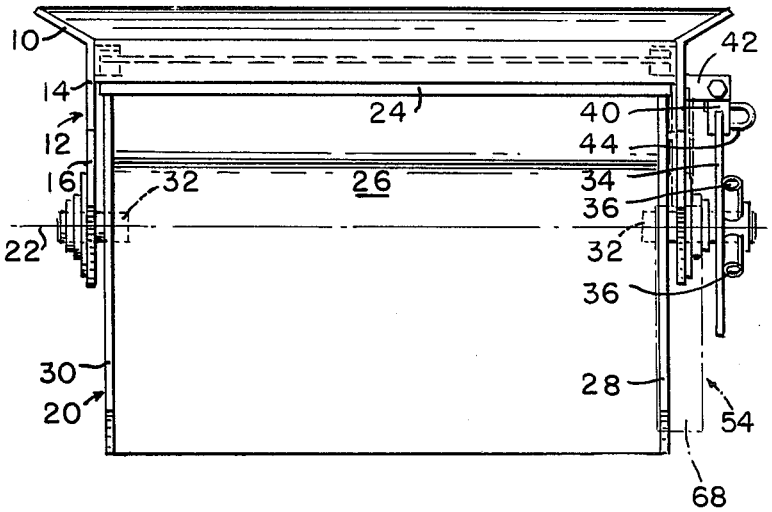
FIG. 3
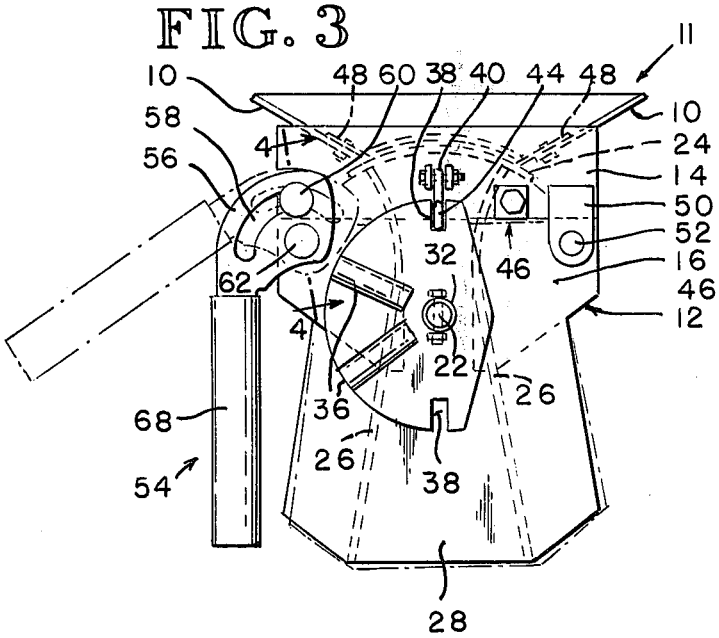

CLOSURE ACTUATING DEVICE FOR RAILWAY HOPPER CAR DOORS

BACKGROUND OF THE INVENTION

1. Field of the Invention

This invention relates to a device for freeing rotation of discharge control doors controlling discharge of particulate material from a container therefor.

2. Prior Art Relating to the Disclosure

U.S. Pat. Nos. 3,654,872 and 3,822,650 describe discharge control doors fitted onto railway hopper cars for discharging material, such as railroad ballast, outside of or between the rails of railroad tracks. Under certain conditions, fines in the material being discharged become compacted on the top arcuate surface of the discharge doors and make the doors difficult to rotate to the open or closed positions because of the increased pressure and bearing area of the compacted fines which increase the friction moment between the top surface of the doors and the terminating edges of the discharge openings. This application is directed to means for alleviating this problem.

SUMMARY OF THE INVENTION

It is a primary object of this invention to provide a device for freeing rotation of discharge control doors of the type described in U.S. Pat. Nos. 3,654,872 and 3,822,650 when the doors resist rotation because of friction buildup between the terminating edges of the discharge openings associated with the doors and the top arcuate surface of the discharge doors covering the discharge openings in the closed position.

It is a further object of this invention to provide a device which adjustably increases the clearance between the discharge opening of a container holding a particulate material and the surface of a discharge door covering the discharge opening for freeing rotation of the discharge door.

It is a further object of this invention to provide discharge control doors for controlling discharge of particulate material from containers therefor wherein the discharge doors covering the discharge openings can be lowered relative to the discharge openings as necessary to increase the clearance between the terminating edges of the discharge openings and the top surfaces of the discharge control doors covering the openings to free rotation of the doors.

BRIEF DESCRIPTION OF THE DRAWINGS

FIG. 1 is a side elevational view of a hopper car of conventional design with the discharge openings thereof fitted with discharge control doors;

FIG. 2 is a side elevational view of a discharge control door including the device for freeing rotation and illustrating the positions to which the control doors may be moved to free rotation thereof;

FIG. 3 is a front view of the discharge control door of FIG. 1; and

FIG. 4 is a cross-section along line 4—4 of FIG. 1.

DESCRIPTION OF THE PREFERRED EMBODIMENTS

Although the discharge control doors of this invention are described for use with railroad hopper cars 1, as illustrated in FIG. 1, the control doors can be fitted onto discharge openings of stationary containers holding particulate material or containers carried by other transportation means. Referring to FIG. 2, reference numeral 10 illustrates sloping extension plates which extend from the lower edges of longitudinal discharge openings formed in the bottom wall of a container or railroad hopper car. When used with conventional railroad hopper cars, generally two discharge openings are cut in the bottom wall of the hopper car above each rail. At each end of each of the discharge openings 11, pairs of supports 12 extend downwardly to provide support for the discharge control door assemblies 20. Each of the supports 12 is sectioned into an upper portion 14 and a lower portion 16, the purpose of which will be described later in detail. Between each pair of supports 12, a discharge control door assembly 20 is pivotally mounted for rotation about a pivot axis 22.

The discharge control door assembly is best illustrated in FIG. 2, which illustrates an end view of one of the discharge control doors. Each discharge control door includes an arcuate top surface plate 24, the upper surface of which has a radius equal to the distance from pivot axis 22 to substantially the lower terminating edges of the discharge opening formed by extension plates 10. The arcuate surface 24 extends the full length and width of the discharge opening 11 and covers the opening entirely, permitting no discharge of particulate material from the container when the door is in the normally closed position shown in FIG. 1.

Opposed, curved discharge plates 26 are secured to the underside of the arcuate plate 24 and extend downwardly. Each of these plates is curved inwardly relative to the other, beginning at the point of attachment to arcuate plate 24, and then curved outwardly relative to one another. This design allows better flow of particulate material thereover and a wider opening between the plate and the terminating edges of the extension plates 10 when the discharge control door assembly is rotated to the open position. End plates 28 and 30 are secured to the ends of the discharge plates 26 and the arcuate surface 24. Each end plate extends beyond its intersection with each of the discharge plates 26 to form a chute which channels the material being discharged.

Stub shafts 32 extend through and are secured to the end walls 28 and 30 of the discharge control door assemblies, as illustrated in FIG. 3. The ends of each of the shafts extend through openings and are supported for rotation in the respective lower portions 16 of the supports 12. The axes of shafts 32 are coincident with pivot axis 22. When mounted on a railroad hopper car, the pivot axis for each of the discharge control door assemblies is preferably directly above its associated rail and in the same vertical plane. The discharge control door assemblies are mounted so that they will normally remain in closed position, as illustrated in FIG. 2.

Attached to each of the discharge control door assemblies are actuating means permitting rotation of the control door assemblies clockwise or counterclockwise to the open position to allow discharge of material contained in the container out and down one of the chutes formed by the discharge plates 26 and end plates 28 and 30, depending on clockwise or counterclockwise rotation. The actuating means is best seen in FIGS. 2 and 3 and includes a half-moon plate 34 fixed to the end of shaft 32. Half-moon plate 34 includes one or more integrally attached annular sleeves 36 having openings therein of sufficient size to receive a length of pipe or rod for manual rotation of the discharge control door assembly. The plate 34 also has opposed slots 38 cut therein to receive a latch 40 to lock the plate and discharge control door assembly against rotation when desired. The latch is pivotally supported for rotation at its upper end from a latch support 42 extending outwardly from the upper portion 14 of support 12. A closed loop 44 may be provided on the latch, as illustrated in FIG. 3, so as to allow easy unlocking of the discharge control door assembly for rotation.

An adjustable friction brake assembly 46 is provided to hold the discharge control door assembly open to a predetermined set position. The details of the friction brake assembly are described and illustrated in U.S. Pat. No. 3,822,650 and reference may be made to that patent for a detailed description of the structure of the frictional brake assembly. The braking force exerted by the friction brake against the end plate of the door assembly is adjusted to equalize the forces tending to move the door assembly back to its normally closed position. These forces include the weight of the door and counterweight, if any, in the door, and the weight of the particulate material flowing over the discharge plate during discharge. The pressure of the friction element of the friction brake assembly against the end wall of the discharge control door assembly is adjustable so that the door, when moved to the open position to discharge particulate material, remains in the open position until a force exerted on the door returns the door to the closed position.

The gap between the terminating edges of the slope sheets or extensions 10 and the top surface of the arcuate member 24 is made adjustable by providing adjustable elements 48, each secured by a bolt and nut to each of the terminating edges of the slope sheets, as illustrated in phantom in FIG. 2.

When unloading certain particulate materials, the fines contained in the material tend to compact on surfaces of the container holding them, as well as on the top surfaces of each of the arcuate members 24 of each of the discharge doors. The increased pressure and bearing area of the compacted fines formed on the top surfaces of the arcuate members increases the friction moment and resists opening of the doors. To alleviate this problem, a camming device is provided to lower the discharge control door assembly and increase the clearance or gap between the terminating edges of the discharge opening and the top surface of the arcuate member 24, thereby reducing the friction and allowing the door to open as it should. To accomplish this, the support plates 12 for the discharge control door assembly are separated into two portions, an upper portion 14 and a lower portion 16. The lower portion is connected at one end to the upper portion by a hinge assembly 50 secured to the upper portion 14 and supporting the lower portion 16 by means of a pin 52 extending through the hinge assembly and lower portion 16 of support 12. The opposite side of the lower portion 16 is supported by a cam head 56 having a slot 58 therein, as illustrated in FIG. 2. The cam head 56 is connected to the lower plate 16 by pin 62, which extends through the lower plate 16. The cam head is connected to the upper plate by pin 60, which extends through the upper plate, the upper pin riding in the slot 58. Each of the pins 60 and 62 is equipped with steel bushings 64 and 66, as illustrated in FIG. 4. A handle 68 is connected to the cam head 56 as illustrated. Lock washers 70 retain the pins in place. As the cam head is rotated from the position shown in FIG. 1 to the position illustrated in phantom in FIG. 1, the distance between the pivot pin 60 and the support pin 62 increases, allowing the lower plate to drop in relation to the upper plate 12 on that side. This is due to the eccentric slot 58, whose distance from the axis of pin 62 varies from one end of the slot to the other. The other side of the plate 16 is restrained by the hinge so that the net effect is a movement of the door assembly in a generally downward direction. This increases the clearance between the top surface of arcuate member 24 and the terminating edges of the discharge opening to allow normal rotation of the door to the open or closed positions, as may be desired.

The embodiments of the invention in which a particular product or privilege is claimed are defined as follows:

1. A discharge control door assembly for controlling discharge of particulate material from a hopper car having side walls and a bottom wall, comprising:

opposed sloping extension plates extending from longitudinal discharge openings formed in the bottom wall of the hopper car having terminating edges forming a discharge opening in the bottom wall of the hopper car, parallel support plates extending downwardly from the opposite sides of the discharge opening transverse to the extension plates, each support plate including an upper portion and a lower portion, means at one side of each of the support plates hinging the lower portion of the support plate to the upper portion, a discharge control door assembly including a segment having an upper arcuate surface supported by the lower plate for rotation about a pivotal axis extending parallel to the length of and beneath the discharge opening equidistantly from the terminating edges of the extension plates, the control door assembly rotatable between a closed position wherein the segment covers the discharge opening and an open position wherein the segment uncovers the discharge opening an amount depending on the degree of rotation for discharge of material from the hopper car through the discharge opening, and means at the other side of each of the support plates connecting the lower portion to the upper portion for shifting the pivotal axis downwardly in relation to the upper portion to allow the upper arcuate surface of the discharge control door assembly to lower and increase the clearance between the arcuate surface and the terminating edges of the extension plates.

2. The device of claim 1 wherein the means at the other side of the support plate includes pins extending through the upper and lower support plates in direct opposed relationship, a cam member secured to one of the plates for rotation by one of the pins, the cam member having a slot therein eccentric with respect to the axis of the pin supporting the cam member, the other pin riding in the eccentric slot so that as the cam member is rotated, the distance between the support pin and the pin riding the slot increases, allowing the lower plate and discharge control door assembly to drop in relation to the upper plate.

* * * * *